US008468734B2

(12) United States Patent
Meller et al.

(10) Patent No.: US 8,468,734 B2
(45) Date of Patent: Jun. 25, 2013

(54) PISTOL ACCESSORY

(76) Inventors: Yehuda Meller, Rishon Lezion (IL); Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 13/367,401

(22) Filed: Feb. 7, 2012

(65) Prior Publication Data

US 2012/0198744 A1 Aug. 9, 2012

Related U.S. Application Data

(60) Provisional application No. 61/440,408, filed on Feb. 8, 2011.

(51) Int. Cl.
*F41C 23/10* (2006.01)

(52) U.S. Cl.
USPC ..... 42/90; 42/85; 42/71.02; 89/1.4

(58) Field of Classification Search
USPC ..... 42/71.02, 85, 90, 106; 89/1.4
See application file for complete search history.

(56) References Cited

U.S. PATENT DOCUMENTS

| | | | | |
|---|---|---|---|---|
| 1,680,186 | A * | 8/1928 | Von Frommer | 42/106 |
| 5,735,070 | A * | 4/1998 | Vasquez et al. | 42/1.02 |
| 6,775,940 | B2 * | 8/2004 | Dworzan et al. | 42/1.01 |
| 7,997,023 | B2 * | 8/2011 | Moore et al. | 42/117 |
| 2004/0200109 | A1 * | 10/2004 | Vasquez | 42/1.01 |
| 2011/0088539 | A1 * | 4/2011 | Oz | 89/1.4 |
| 2011/0154710 | A1 * | 6/2011 | Hatfield | 42/90 |

* cited by examiner

*Primary Examiner* — Michael Carone
*Assistant Examiner* — Derrick Morgan
(74) *Attorney, Agent, or Firm* — Deborah Gador

(57) ABSTRACT

An accessory for a semi-automatic pistol having a slide, the accessory including a pair of protruding engaging members for engagement by a hand or fingers of a user, a mounting element coupled to each engaging member, for releasably mounting the engaging member on the slide of the pistol. Preferably, the accessory further includes a mounting plate slideably engagable in a rear slot of the slide, and the mounting elements are affixable to the mounting plate.

13 Claims, 5 Drawing Sheets

PISTOL ACCESSORY

RELATED APPLICATIONS

This application claims the benefit of U.S. provisional application Ser. No. 61/440,408 filed 8 Feb. 2011.

FIELD OF THE INVENTION

The present invention relates to a pistol accessory, in general and, in particular, to an accessory for a semi-automatic pistol.

BACKGROUND OF THE INVENTION

Semi-automatic pistols include a mechanism which allows automatic reloading of the pistol upon firing a bullet. Typically, semi-automatic pistols use recoil energy, resulting from firing one bullet, to reload the next bullet into the pistol's chamber. Thus, pulling the trigger causes one bullet to be fired and the next bullet in the magazine to be loaded automatically, without having to manually load the next bullet.

One example of a semi-automatic pistol is a Glock® pistol. A Glock® pistol includes a slide which houses the firing mechanism and the barrel, through which the bullet is fired. During the recoil process, the slide slides backwards, along tracks in the top of the pistol's frame. When the slide is in its backwards position, a bullet from the magazine is urged into the barrel. The slide is then pulled forward by the recoil spring, thereby completing the loading process of the pistol, and at least partially cocking the firing mechanism.

However, after firing the last bullet in the magazine, the pistol is reloaded by inserting a full magazine into the receiver and by manually pulling the slide backwards, allowing the first bullet in the magazine to enter the barrel, following which, the slide is urged forward by the recoil spring. Similarly, unloading the pistol requires pulling the slide fully to the rear, so as to eject the bullet from the barrel.

Pulling the slide backwards against the force of the recoil spring requires a good grip of the slide and a large force applied to the slide, due to its straight, parallel sides. At present, a row of shallow cocking serrations is formed along the side of the slide. However, these serrations are not sufficient for easy gripping and pulling back of the slide.

Accordingly, there is a long felt need for a slide for a semi-automatic pistol which facilitates the process of reloading and unloading of the pistol, and it would be very desirable to have a slide which allows a stable grip and requires relatively little force to pull the slide backwards.

SUMMARY OF THE INVENTION

According to the present invention there is provided an accessory for a semi-automatic pistol. The accessory includes a pair of engaging members for engaging the hand or fingers of a user, and a mounting element coupled to each engaging member, for mounting the engaging members on a slide of the pistol.

According to one embodiment the mounting element includes a shoulder for affixing to the rear of the slide.

Further according to one embodiment, there is provided a rear mounting plate for attaching to the slide as a replacement rear cover plate for the slide and the shoulder is mounted to the mounting plate.

There is also provided a method for forming an accessory for a semi-automatic pistol, the method including forming a pair of engaging members for engaging the hand or fingers of a user, coupling a mounting element to each of the engaging members, and affixing the mounting elements to a rear mounting plate engageable in a slide of a semi-automatic pistol for removably mounting the engaging members on the slide.

There is further provided, according to the invention, an accessory for a semi-automatic pistol having a slide, the accessory including a pair of protruding engaging members for engagement by a hand or fingers of a user, a mounting element including a shoulder coupled to each engaging member, for releasably mounting the engaging member on the slide of the pistol, and a rear mounting plate slideably engagable in a rear slot of the slide, the mounting elements being affixed to the rear mounting plate, wherein the shoulder portion has adjustable screw holes for mounting the shoulder to the mounting plate.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a slide grip for a slide of a semi-automatic pistol. The slide grip facilitates grasping and pulling the slide during reloading or unloading of the pistol. The slide grip includes two engaging members for engagement by the hand or fingers of the user, while he or she is pulling the slide backwards. Each engaging member is removably mounted on one side of the slide, substantially at the rear portion of the slide, and protrudes slightly from the slide. When the user grips the slide during reloading or unloading of the pistol, the engaging members engage the user's hand or fingers. Thus, the slide grip facilitates pulling back the slide utilizing relatively little force for reloading or unloading the pistol. Preferably, the engaging members have a concave ergonomic shape which is designed to fit or be engaged by the fingers or hand of the user, so as to allow the user to easily grip the slide or the slide grip and to pull back the slide.

According to an embodiment of the invention, mounting the engaging members on the slide is carried out by means of a mounting shoulder, coupled to or integrally formed with each engaging member, for affixing the engaging members to the rear of the slide. Preferably, the mounting shoulder is affixable to a rear mounting plate removably mounted in the slide.

According to an embodiment of the invention, the slide grip further includes side portions, one extending from each engaging member, each having a gripping surface, preferably including grooves and ridges, for facilitating gripping of the slide grip while pulling the slide backwards. Thus, the slide grip facilitates the pulling of the slide, and reduces slippage of the user's hand that can occur when manually loading or unloading the pistol.

Figure 1:
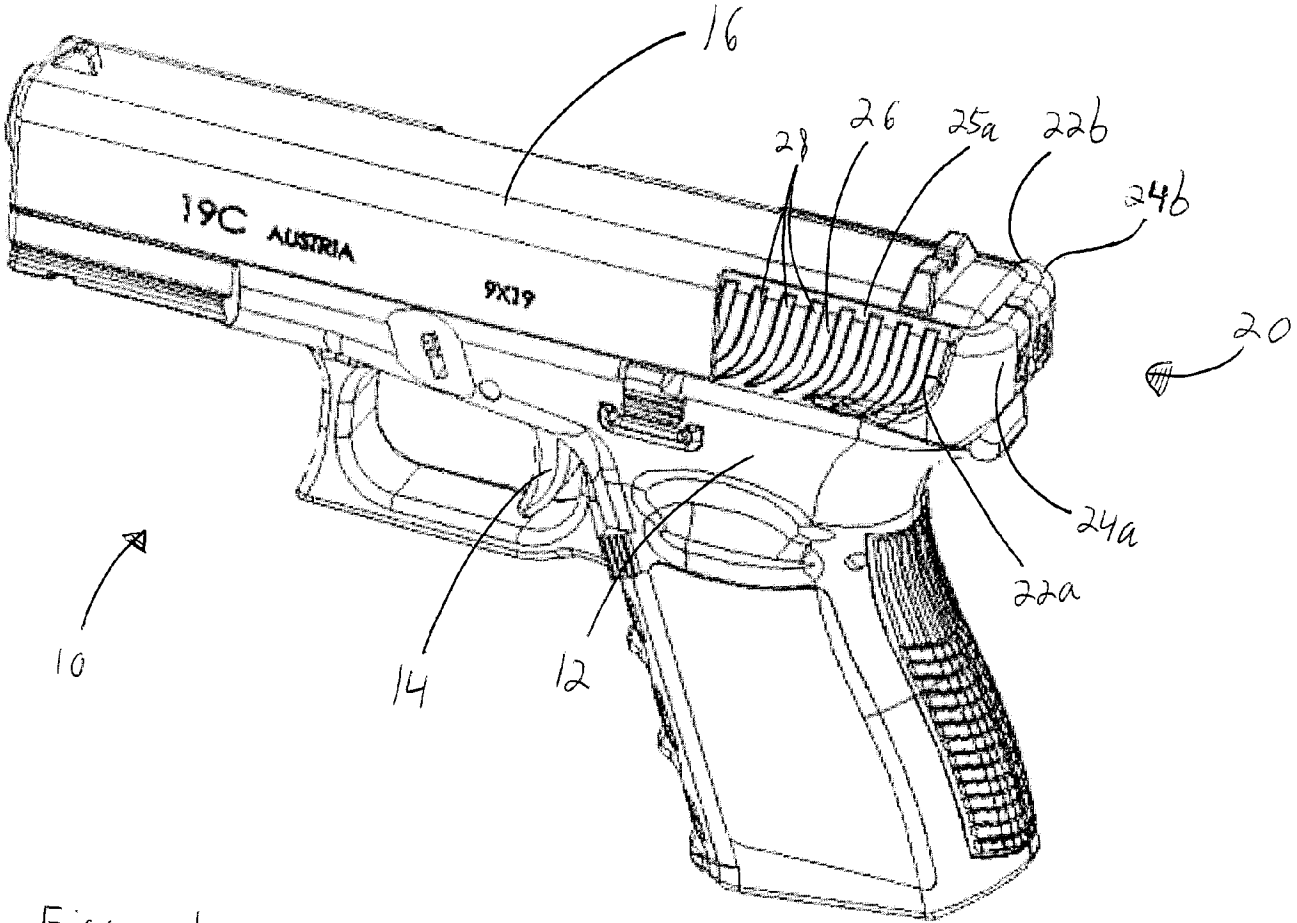
FIG. 1 is a schematic illustration of a semi-automatic pistol having a slide grip constructed and operative in accordance with one embodiment of the present invention.

FIG. 1 is a schematic illustration of a pistol 10 having a slide grip 20, constructed and operative in accordance with one embodiment of the present invention, and mounted thereon. Pistol 10, here illustrated as a Glock® pistol, includes a frame 12, a trigger 14, and a slide 16 configured for sliding back and forth relative to frame 12, as known. Slide grip 20 includes two engaging members 22*a* and 22*b* mounted on the side portions or walls of slide 16, substantially at the rear portion of slide 16. Engaging members 22*a* and 22*b* protrude from slide 16 and preferably have a rounded or concave ergonomic shape for engagement by the user's hand or fingers. In this embodiment, each engaging member includes a side portion extending from the engaging member. The side portion covers at least a portion of the gripping surface on the sides of the slide and may, themselves, have an external textured gripping surface, for example, including grooves and ridges. Each engaging member further includes a mounting element, extending along the rear of the slide, here illustrated as a shoulder portion 24*a* and 24*b*, respectively, for mounting the engaging member on the slide 16.

Figure 2:
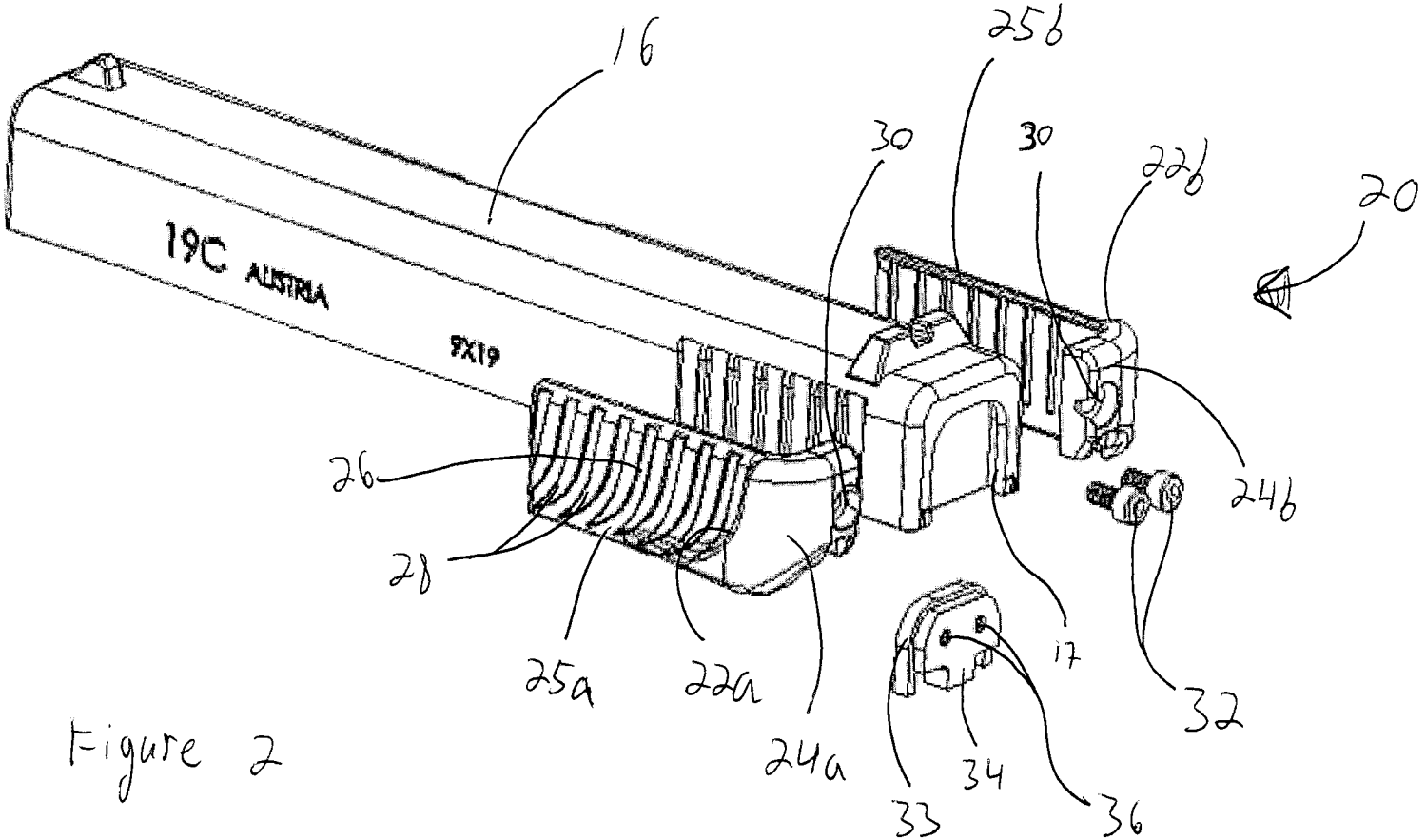
FIG. 2 is an exploded view of the slide of the pistol of FIG. 1.
Figure 3:
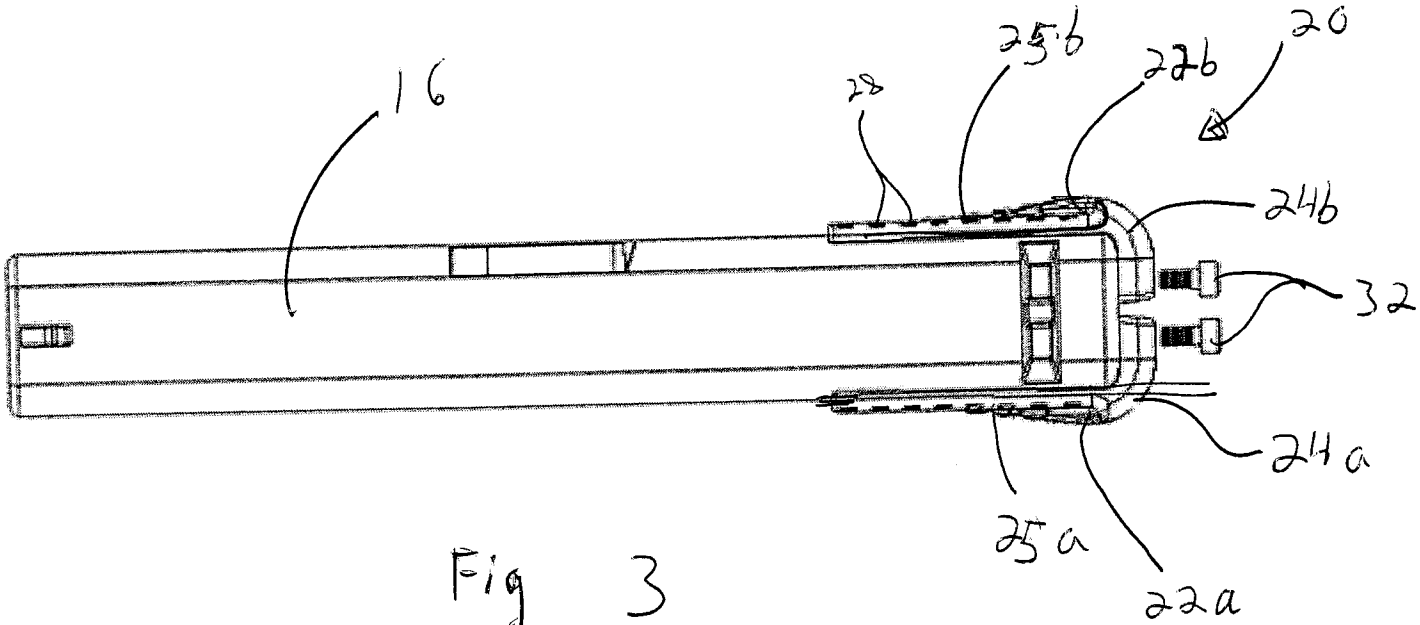
FIG. 3 is a top view illustration of the slide of the pistol of FIG. 1.

FIGS. 2 and 3 are an exploded view and a top view, respectively, of slide 16 of pistol 10 with slide grip 20 of FIG. 1 showing the cocking serrations. Slide grip 20 includes two engaging members 22*a* and 22*b* protruding from slide 16 and shoulder portions 24*a* and 24*b*, for affixing the engaging members 22*a* and 22*b*, respectively, to the rear of slide 16. According to the embodiment of FIG. 2, each of engaging members 22*a* and 22*b* includes a side portion 25*a* and 25*b*, respectively, having a gripping surface 26, here illustrated as a surface having a plurality of cocking serrations 28. Gripping surface 26 facilitates the grip of the side portion, while pulling slide 16 backwards. It will be appreciated that gripping surface 26 also provides reinforcement to side portions 25*a* and 25*b*.

Preferably, each one of shoulder portions 24*a* and 24*b* includes a screw receiving aperture 30 for receiving screws 32. According to this embodiment, shoulder portions 24*a* and 24*b* are coupled to the rear of slide 16 by means of a mounting plate 34. Mounting plate 34 has screw holes 36 therein. Preferably, shoulder portions 24*a* and 24*b* include slightly elongated screw receiving apertures 30 in registration with the screw holes 36. Screws 32 are inserted through elongated screw receiving apertures 30 on shoulder portions 24*a* and 24*b*, and fastened to screw holes 36 on mounting plate 34. The elongated apertures permit adjustment of the location of the slide grip on the slide and the engagement between the sides of the slide grip and the slide itself, which typically is required due to the lack of identity between slides and their sides. Preferably, mounting plate 34 is substantially the same size and shape as the conventional slide rear cover plate mounted in tracks at the rear of the slide of the semiautomatic pistol. Thus, mounting plate 34 can be mounted at the rear of the slide and serve as a rear cover plate of slide 16. It is affixed to the slide 16 in the same way as the conventional rear cover plate. For example, if the rear wall of slide 16 includes a groove 17 for receiving a rear cover plate, mounting plate 34 may include a track 33 complementary to groove 17, for mounting in the groove on slide 16. This way, mounting the slide grip on the pistol can be carried out by simply replacing the original rear cover plate of the slide, without having to drill holes in the slide, or to weld the slide grip on the slide. The mounting plate of the invention can be slid into the groove 17, instead of the original cover plate, without having to make any changes in the original slide or pistol.

Preferably, engaging members 22*a*, 22*b* have a rounded ergonometric shape designed to engage the fingers or hand of the user. They may be curved to complement the shape of a finger. In this way, when the user grips slide grip 20 and pulls slide 16 backwardly, engaging members 22*a*, 22*b* abut or curve around the user's finger and preclude slippage of the hand that is gripping slide 16. In fact, in certain embodiments, a user need not hold the sides of the slide grip at all—it is sufficient to pull the engaging members 22*a* and 22*b*. Alternatively, the engaging members can have any other shape that permits engagement by a user's fingers.

According to preferred embodiments of the invention, the angle between side portion 25*a* and 25*b*, and shoulder portions 24*a* and 24*b*, respectively, is slightly smaller than 90 degrees. In this way, when shoulder portions 24*a* and 24*b*, are affixed to the rear of slide 16, side portions 25*a* and 25*b* push against the sides of slide 16. In addition, due to the angle between side portions 25*a* and 25*b* and shoulder portions 24*a* and 24*b*, respectively, side members 22*a* and 22*b* can be urged more tightly against the sides of slide 16 before screws 32 are tightened, providing tighter frictional engagement between the slide grip and the slide.

While the slide grip has been described above as having two separate portions, alternatively, the slide grip can be formed as a single element, i.e., U-shaped, having two engagement members thereon.

Operation of the slide grip of the present invention is as follows. First, a slide grip having a pair of engagement members is mounted on the slide. This can be accomplished by removing the original rear cover plate of the slide and replacing it with a mounting plate having screw holes. The slide grip, or individual engagement members, is placed against the sides of the slide and screws are inserted through elongate or oval apertures in the shoulders of the engagement members and into the screw holes in the replacement plate. Now the sides of the engagement members are pressed against the slide to the desired amount, and the screws are tightened, affixing the engagement members in the desired location.

After inserting a pistol magazine into the receiver of the pistol, the user holds slide grip 20 and/or shoulder portions 24*a* and 24*b* and pulls back slide 16, thereby loading the first bullet from the magazine into the chamber. Similarly, when the pistol's chamber is loaded with a bullet and the user wishes to unload the pistol, the user holds slide grip 20 and/or shoulder portions 24*a* and 24*b* and pulls back slide 16, thereby ejecting the bullet from the chamber. The recoil spring urges slide 16 back to the forward position. Utilizing slide grip 20 facilitates the pulling of slide 16, reducing the force required and reducing slippage of the user's hand that can occur when manually loading or unloading the pistol.

Figure 4:
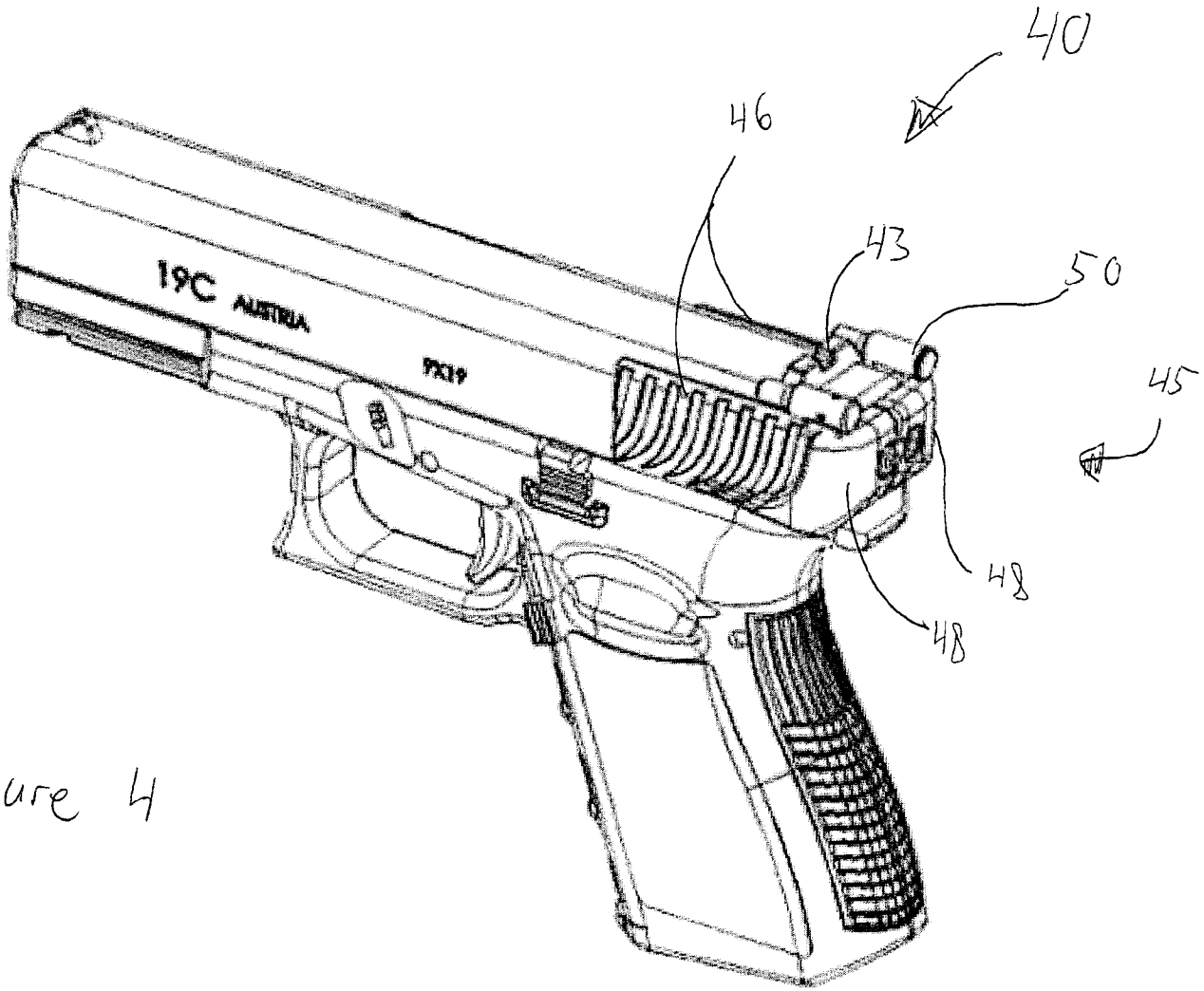
FIG. 4 is a schematic illustration of a semi-automatic pistol having a slide grip constructed and operative in accordance with another embodiment of the present invention.

FIG. 4 is a side perspective view of a Glock® pistol 40 having a slide grip 45 constructed and operative in accordance with another embodiment of the present invention, mounted thereon. Slide grip 45 is substantially the same as side grip 20 of FIG. 1 and includes engaging members 46 and shoulder portions 48. Slide grip 45 further includes a lighting accessory 50, mounted thereon. Lighting accessory 50, here illustrated as a pair of tritium tubes, is mounted on shoulder portions 48 adjacent the rear sight 43 of pistol 40. It will be appreciated that other accessories may, alternatively, be mounted on the slide grip, for example, a laser pointer, etc.

Figure 5:
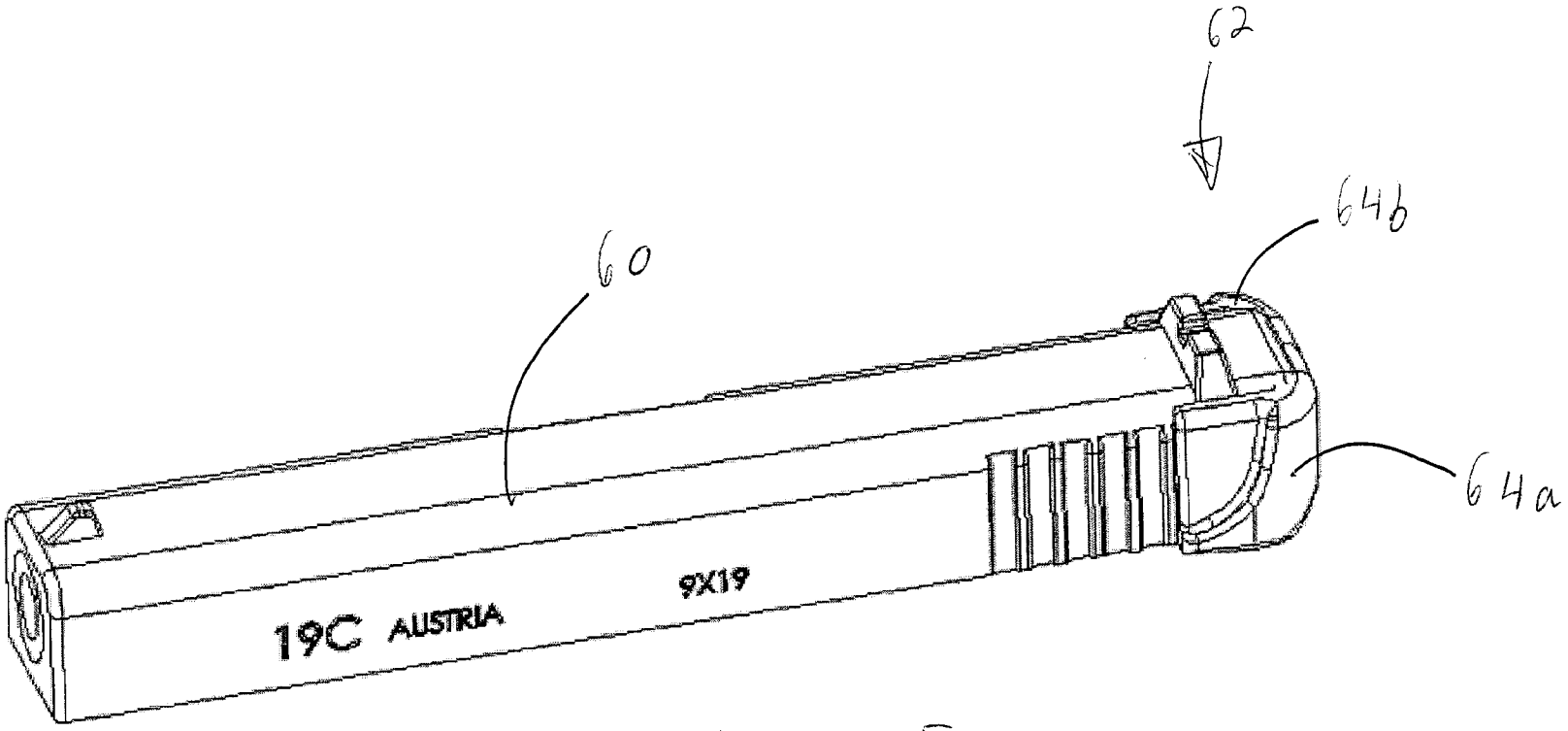
FIG. 5 is a schematic illustration of a slide of a semiautomatic pistol, having a slide grip mounted thereon, constructed and operative in accordance with another embodiment of the present invention.

FIG. 5 is a perspective view of a slide 60 of a semiautomatic pistol, having a slide grip 62 mounted thereon, constructed and operative in accordance with another embodiment of the present invention. Slide grip 62 includes engaging members

64*a* and 64*b*, and shoulder portions 66*a* and 66*b*, similar to those of slide grip 20 of FIG. 1. However, slide grip 62 does not include side portions extending along the sides of slide 60, but only engaging members 64*a* and 64*b*. When the user pulls slide 60 backwards, his/her hand or fingers engage engaging members 64*a* and 64*b* to facilitate gripping and pulling of slide 60, while holding the sides of the slide 60 itself, without requiring holding the sides of the slide grip.

While the slide grip of the present invention has been illustrated hereinabove with reference to use on a Glock® pistol, it will be appreciated that, alternatively, the slide grip can be mounted on any other pistol which has a slide with a rear cover plate, such as a Springfield Armory pistol, or a Smith & Wesson pistol, etc.

As stated above, it is a particular feature of some embodiments of the invention that the accessory can be mounted on the pistol merely by replacing the rear cover plate of the slide, without requiring a permanent change to the original slide or pistol.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. An accessory for a semi-automatic pistol having a slide, the accessory comprising:

a pair of protruding engaging members for engagement by a hand or fingers of a user;

a mounting element coupled to each said engaging member, for releasably mounting said engaging member on the slide of the pistol;

wherein said mounting element includes a shoulder portion having adjustable screw holes for mounting said shoulder portion to a mounting plate of the slide.

2. The accessory according to claim 1, wherein each said mounting element merges into an elongate side portion extending along the side of the slide.

3. The accessory according to claim 1, wherein said mounting plate is slideably engagable in a rear slot of the slide, said mounting elements being affixable to said mounting plate.

4. The accessory according to claim 3, wherein said mounting plate is substantially a same size and shape as a conventional slide cover plate and is mounted in cover plate tracks at the rear of the slide.

5. The accessory according to claim 1, further comprising at least two screw holes through said mounting plate; and wherein said adjustable screw holes are slightly elongated screw receiving apertures in said shoulder portions in registration with said screw holes in the mounting plate.

6. The accessory according to claim 1, further comprising a lighting accessory mounted on said shoulder portions adjacent a rear sight of the pistol.

7. The accessory according to claim 1, further comprising side portions, one extending from each engaging member, each having a gripping surface for facilitating gripping of the slide grip.

8. An accessory for a semi-automatic pistol having a slide, the accessory comprising:

a pair of protruding engaging members for engagement by a hand or fingers of a user;

a mounting element including a shoulder coupled to each said engaging member, for releasably mounting said engaging member on the slide of the pistol; and a rear mounting plate slideably engagable in a rear slot of the slide, said mounting elements being affixed to said rear mounting plate;

wherein said shoulder portion has adjustable screw holes for mounting said shoulder to said mounting plate.

9. The accessory according to claim 8, further comprising side portions, one extending from each engaging member, each having a gripping surface for facilitating gripping of the slide grip.

10. The accessory according to claim 8, further comprising at least two screw holes through said mounting plate; and wherein said adjustable screw holes are slightly elongated screw receiving apertures in said shoulder portions in registration with said screw holes in the mounting plate.

11. The accessory according to claim 8, wherein said mounting plate is substantially a same size and shape as a conventional slide cover plate and is mounted in cover plate tracks at the rear of the slide.

12. The accessory according to claim 8, further comprising a lighting accessory mounted on said shoulder portions adjacent a rear sight of the pistol.

13. A method for operating a slide grip for a semi-automatic pistol having a slide with a rear cover plate, the method comprising:

removing the rear cover plate of the slide;

replacing said rear cover plate with a mounting plate having screw holes;

placing a pair of engagement members having mounting elements defining apertures against sides of the slide, with said apertures in registration with said screw holes in said mounting plate;

inserting screws through said elongate apertures of the mounting elements and into the screw holes in the mounting plate; and tightening the screws so that the sides of the engagement members are pressed against the slide to a desired amount, thereby affixing the engagement members in a desired location.

* * * * *